US009478347B2

(12) United States Patent
Sarver et al.

(10) Patent No.: US 9,478,347 B2
(45) Date of Patent: Oct. 25, 2016

(54) DRY TYPE TRANSFORMER WITH IMPROVED COOLING

(75) Inventors: Charlie Sarver, Rocky Gap, VA (US); William E. Pauley, Jr., Bland, VA (US)

(73) Assignee: ABB TECHNOLOGY AG, Zurich (CH)

( * ) Notice: Subject to any disclaimer, the term of this patent is extended or adjusted under 35 U.S.C. 154(b) by 633 days.

(21) Appl. No.: 12/821,425

(22) Filed: Jun. 23, 2010

(65) Prior Publication Data

US 2010/0328005 A1 Dec. 30, 2010

Related U.S. Application Data

(60) Provisional application No. 61/221,836, filed on Jun. 30, 2009.

(51) Int. Cl.

| | |
|---|---|
| ***H01F 30/12*** | (2006.01) |
| ***H01F 21/12*** | (2006.01) |
| ***H01F 27/28*** | (2006.01) |
| ***H01F 27/08*** | (2006.01) |
| ***H01F 27/32*** | (2006.01) |
| ***H01F 41/12*** | (2006.01) |

(52) U.S. Cl.

CPC ..... *H01F 27/085* (2013.01); *H01F 27/327* (2013.01); *H01F 41/127* (2013.01); *H01F 2027/328* (2013.01)

(58) Field of Classification Search

CPC ..... H01F 27/327
USPC ..... 336/5, 150, 190
See application file for complete search history.

(56) References Cited

U.S. PATENT DOCUMENTS

| | | | | |
|---|---|---|---|---|
| 3,996,544 | A | | 12/1976 | Mori et al. |
| 4,471,337 | A | | 9/1984 | Mausz et al. |
| 4,488,134 | A | | 12/1984 | Pfeiffer |
| 4,523,171 | A | * | 6/1985 | Altmann et al. ..... 336/96 |
| 5,194,841 | A | | 3/1993 | Galloway et al. |

(Continued)

FOREIGN PATENT DOCUMENTS

| | | | |
|---|---|---|---|
| JP | 57118618 | A | 7/1982 |
| JP | 60065505 | A | 4/1985 |

(Continued)

OTHER PUBLICATIONS

First Office Action for counterpart patent application No. 201080029566.7, State Intellectual Property Office of the People's Republic of China, issued Dec. 20, 2013 (translation).

*Primary Examiner* — Elvin G Enad
*Assistant Examiner* — Ronald Hinson
(74) *Attorney, Agent, or Firm* — Taft Stettinius & Hollister LLP

(57) ABSTRACT

A distribution transformer having a coil assembly mounted to a ferromagnetic core. The coil assembly includes a resin-encapsulated low voltage coil mounted to the core, a resin-encapsulated first high voltage coil disposed around the low voltage coil, and a resin encapsulated second high voltage coil disposed around the first high voltage coil. The first high voltage coil is separated from the low voltage coil by an annular first space, and the second high voltage coil is separated from the first high voltage coil by an annular second space. The low voltage coil and the first and second high voltage coils are arranged concentrically. The low voltage coil and the first and second high voltage coils have different axial lengths.

16 Claims, 4 Drawing Sheets

(56) References Cited

U.S. PATENT DOCUMENTS

| | | | | |
|---|---|---|---|---|
| 5,267,393 | A | 12/1993 | Purohit et al. | |
| 5,461,772 | A | 10/1995 | Puri | |
| 5,596,305 | A | 1/1997 | Puri | |
| 5,621,372 | A | 4/1997 | Purohit | |
| 5,684,446 | A | 11/1997 | Adkins et al. | |
| 5,986,532 | A * | 11/1999 | Kikuta et al. | 336/83 |
| 6,160,464 | A | 12/2000 | Clarke et al. | |
| 6,201,334 | B1 | 3/2001 | Sargeant et al. | |
| 6,223,421 | B1 | 5/2001 | Lanoue et al. | |
| 6,806,803 | B2 | 10/2004 | Hopkinson et al. | |
| 7,023,312 | B1 | 4/2006 | Lanoue et al. | |
| 2002/0171524 | A1 * | 11/2002 | Tsai | 336/96 |
| 2009/0096562 | A1 * | 4/2009 | Nakadai et al. | 336/67 |

FOREIGN PATENT DOCUMENTS

| | | | |
|---|---|---|---|
| WO | 0039819 | A1 | 7/2000 |
| WO | 2011002650 | A1 | 1/2011 |

* cited by examiner

DRY TYPE TRANSFORMER WITH IMPROVED COOLING

CROSS-REFERENCE TO RELATED APPLICATION

This application claims the benefit of U.S. provisional patent application No. 61/221,836 filed on Jun. 30, 2009, which is hereby incorporated by reference in its entirety.

BACKGROUND OF THE INVENTION

The present invention relates to transformers and more particularly to dry type transformers with improved cooling features.

As is well known, a transformer converts electricity at one voltage to electricity at another voltage, either of higher or lower value. A transformer achieves this voltage conversion using a primary coil and a secondary coil, each of which are wound on a ferromagnetic core and comprise a number of turns of an electrical conductor. The primary coil is connected to a source of voltage and the secondary coil is connected to a load. The ratio of turns in the primary coil to the turns in the secondary coil ("turns ratio") is the same as the ratio of the voltage of the source to the voltage of the load.

A transformer may be cooled by air or a liquid dielectric. An air-cooled transformer is typically referred to as a dry-type transformer. In many applications, such as in or around commercial buildings, it is preferable to use a dry-type transformer instead of a liquid-cooled transformer. Often, the coils of a dry-type transformer are coated with, or cast in, a dielectric resin using vacuum chambers, gelling ovens etc. Encapsulating a coil in a dielectric resin protects the coil, but creates heat dissipation issues. To dissipate the heat from around the coil, cooling ducts are often formed at predetermined positions within the coil. Such cooling ducts improve the operating efficiency of the coil and extend the operational life of the coil. An example of a resin-encapsulated coil with cooling ducts is disclosed in U.S. Pat. No. 7,023,312 to Lanoue et al., which is assigned to the assignee of the present invention and is hereby incorporated by reference.

Although the use of cooling ducts produces good results, the creation of cooling ducts in a coil increases the labor and material costs of the coil. Accordingly, it would be desirable to provide a transformer with resin-encapsulated coils that reduces or eliminates the use of cooling ducts. The present invention is directed to such a transformer.

SUMMARY OF THE INVENTION

In accordance with the present invention, a distribution transformer is provided and includes a coil assembly mounted to a ferromagnetic core. The coil assembly includes a resin-encapsulated low voltage coil, a resin-encapsulated first high voltage coil disposed around the low voltage coil, and a resin encapsulated second high voltage coil disposed around the first high voltage coil. The first high voltage coil is separated from the low voltage coil by an annular first space, and the second high voltage coil is separated from the first high voltage coil by an annular second space. The low voltage coil and the first and second high voltage coils are arranged concentrically.

Also provided in accordance with the present invention is a method of making a distribution transformer. The method includes providing a ferromagnetic core, a resin-encapsulated low voltage coil, a resin-encapsulated first high voltage coil, and a resin-encapsulated second high voltage coil. The low voltage coil is mounted to the core and the first high voltage coil is disposed around the low voltage coil so as to form an annular first space therebetween. The second high voltage coil is disposed around the first high voltage coil so as to form an annular second space therebetween.

BRIEF DESCRIPTION OF THE DRAWINGS

The features, aspects, and advantages of the present invention will become better understood with regard to the following description, appended claims, and accompanying drawings where:

DETAILED DESCRIPTION OF ILLUSTRATIVE EMBODIMENTS

Figure 1:
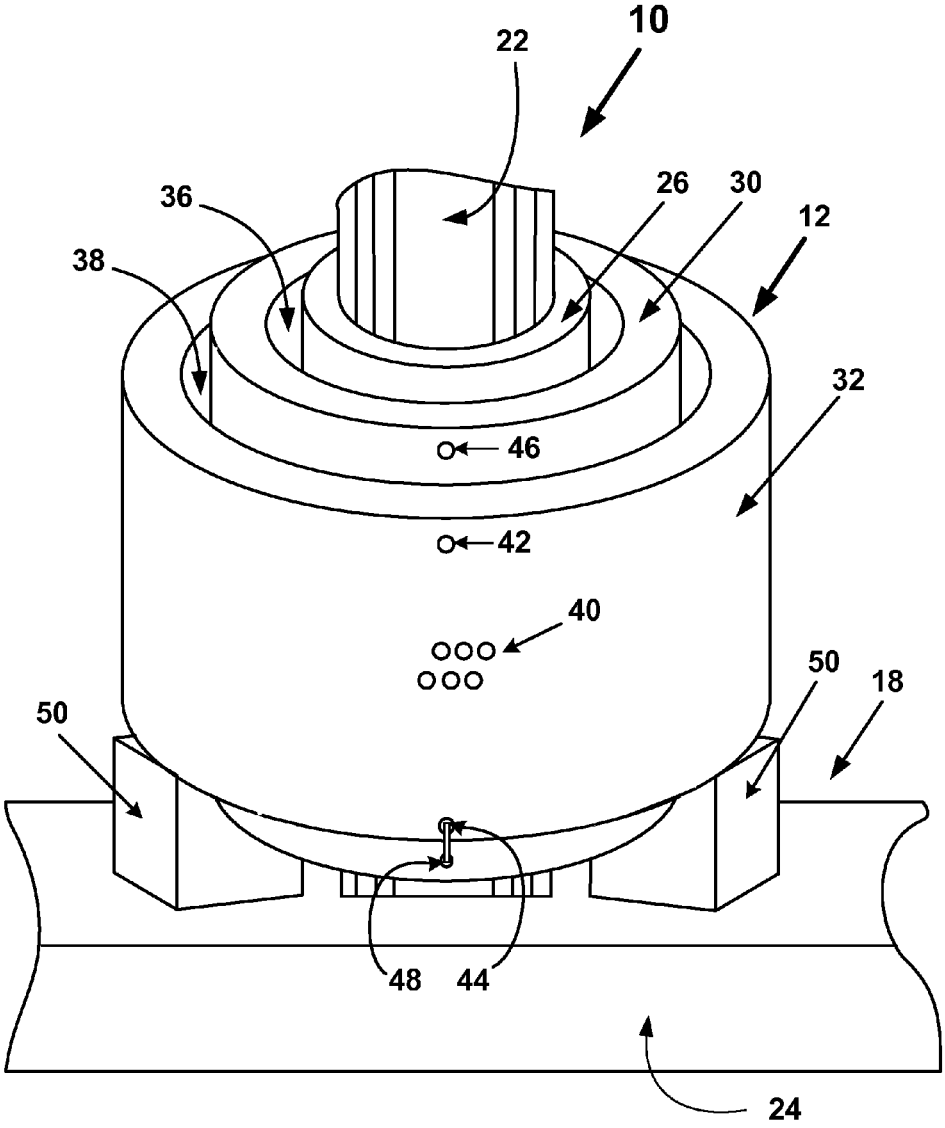
FIG. 1 is a top front perspective view of a portion of a transformer embodied in accordance with the present invention.

It should be noted that in the detailed description that follows, identical components have the same reference numerals, regardless of whether they are shown in different embodiments of the present invention. It should also be noted that in order to clearly and concisely disclose the present invention, the drawings may not necessarily be to scale and certain features of the invention may be shown in somewhat schematic form.

Figure 2:
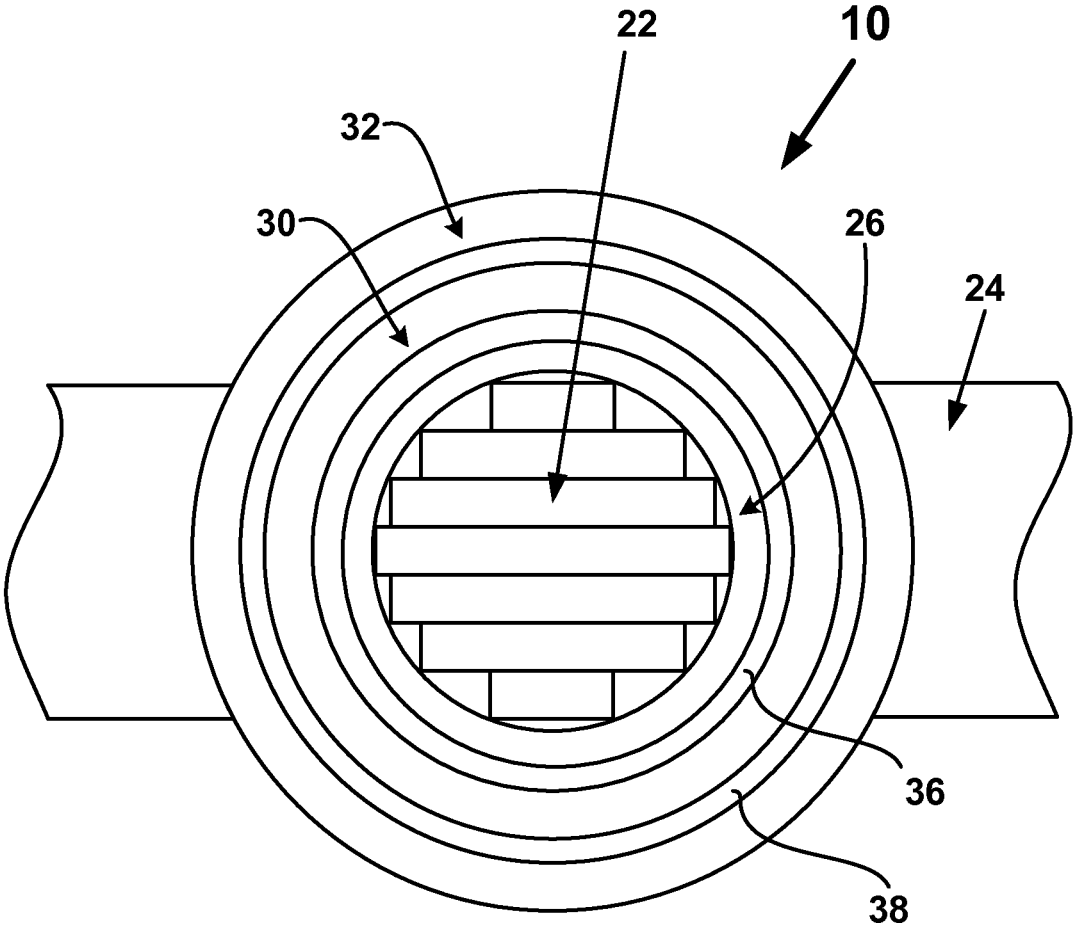
FIG. 2 is a top plan view of the transformer.

Referring now to FIGS. 1 and 2, there is shown a portion of a distribution transformer 10 embodied in accordance with the present invention. The transformer 10 is a distribution transformer and has a kVA rating in a range of from about 112.5 kVA to about 15,000 kVA. A high voltage side of the transformer 10 has a voltage in a range of from about 600 V to about 35 kV, while a low voltage side of the transformer 10 has a voltage in a range of from about 120 V to about 15 kV.

The transformer 10 includes at least one coil assembly 12 mounted to a core 18 and enclosed within an outer housing (not shown). If the transformer 10 is a single-phase transformer, only one coil assembly 12 is provided, whereas if the transformer 10 is a three-phase transformer, three coil assemblies 12 are provided (one for each phase). The core 18 is comprised of ferromagnetic metal (such as silicon grain-oriented steel) and may be generally rectangular in shape. The core 18 includes at least one leg 22 extending between a pair of yokes 24 (only one of which is shown). Three evenly-spaced apart legs 22 may extend between the yokes 24. If the transformer 10 is a single phase transformer, the single coil assembly 12 may be mounted to and disposed around a center one of the legs 22, whereas, if the transformer 10 is a three-phase transformer, the three coil assemblies 12 are mounted to, and disposed around, the legs 22, respectively. As best shown in FIG. 2, each leg 22 may be formed from a plurality of plates having different widths that are arranged to provide the leg 22 with a cruciform cross-section.

Each coil assembly 12 comprises a low voltage coil member 26 including a resin insulation or encapsulation, also referred to herein as resin-encapsulated low voltage coil 26 and a high voltage coil assembly 28 that includes a first high voltage coil member 30 and second high voltage coil member 32, both of which have resin insulation or encapsulation, and which members 30, 32 are also referred to herein as resin-encapsulated first and second high voltage coils 30, 32. As will be described in more detail below, each of the low voltage coil 26, the first high voltage coil 30 and the second high voltage coil 32 are produced separately and then mounted to the core 18. The low voltage coil 26 and the first and second high voltage coils 30, 32 may each be cylindrical in shape. If the transformer 10 is a step-down transformer, the high voltage coil assembly 28 forms a primary coil structure and the low voltage coil 26 forms a secondary coil structure. Alternately, if the transformer 10 is a step-up transformer, the high voltage coil assembly 28 forms a secondary coil structure and the low voltage coil 26 forms a primary coil structure. In each coil assembly 12, the first and second high voltage coils 30, 32 and the low voltage coil 26 are mounted concentrically, with the low voltage coil 26 being disposed within and radially inward from the first and second high voltage coil 30, 32. As best shown in FIG. 2, the low voltage coil 26 is separated from the first high voltage coil 30 by an annular high/low space 36, the radial width of which determines the impedance value of the coil assembly 12. The high/low space 36 extends the entire axial length of the first high voltage coil 30 and has open ends. The first high voltage coil 30 is separated from the second high voltage coil 32 by an annular cooling space 38 that extends the entire axial length of the second high voltage coil 32 and has open ends. The first high voltage coil 30 is electrically connected with the second high voltage coil 32 by one or more jumpers, as described more fully below.

Figure 3:
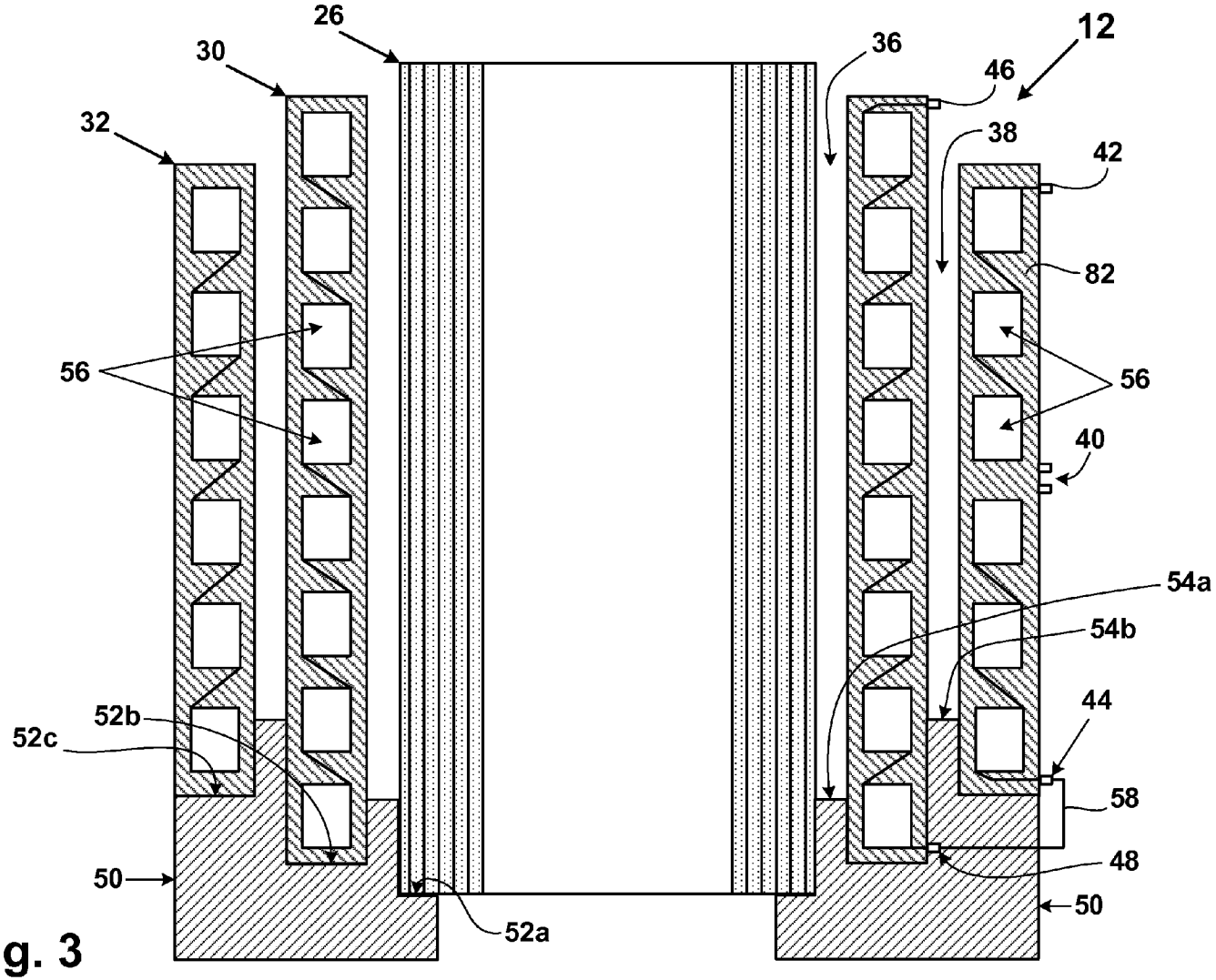
FIG. 3 is a cross-sectional view of a coil assembly of the transformer mounted on support blocks, wherein the coil assembly has first and second high voltage coils constructed in accordance with a first embodiment of the present invention.

The first high voltage coil 30, the second high voltage coil 32 and the low voltage coil 26 all have different axial lengths. More specifically, the low voltage coil 26 has a greater axial length than the first high voltage coil 30, which has a greater axial length than the second high voltage coil 32. These differences in axial length are best shown in FIG. 3. In another embodiment of the present invention, the low voltage coil 26 may have the same axial length as the first high voltage coil 30.

One or more taps extend from the first high voltage coil 30 and one or more taps extend from the second high voltage coil 32. The number and arrangement of these taps depends on the winding structure of the first and second high voltage coils 30, 32, as will be described in more detail below. As shown in FIGS. 1 and 3, taps 40, 42, 44 extend laterally or radially outward from an outer surface of the second high voltage coil 32, while taps 46, 48 extend laterally or radially outward from an outer surface of the first high voltage coil 30. The tap 46 is disposed above the top of the second high voltage coil 32, and the tap 48 is disposed below the bottom of the second high voltage coil 32.

Referring now also to FIG. 3, there is shown a sectional view of the coil assembly 12 supported on a plurality of support blocks 50. In order to better show features of the coil assembly 12, the core 18 is not shown in FIG. 3. The support blocks 50 support and maintain the relative positions of the low voltage coil 26 and the first and second high voltage coils 30, 32. Two or more blocks 50 are used to support each coil. In one embodiment, four blocks 50 are used to support each coil. The support blocks 50 are composed of an insulating material that is strong and durable, such as a high impact plastic. Examples of such plastics include acrylonitrile-butadiene-styrene (ABS) and epoxy resins. Such plastics may be fiber-reinforced. Each block 50 comprises a horizontal support surface 52 for each coil of the coil assembly 12. The support surfaces 52 are separated by vertically-extending spacers 54 that help form and maintain the spacing between each pair of coils. The support surface 52*a* supports the low voltage coil 26, the support surface 52*b* supports the first high voltage coil 30 and the support surface 52*c* supports the second high voltage coil 32. The spacer 54*a* helps form and maintain the high/low space 36 and the spacer 54*b* helps maintain and form the cooling space 38. The spacer 54*a* extends into the high/low space 36, while the spacer 54*b* extends into the cooling space 38.

The low voltage coil 26, the first high voltage coil 30 and the second high voltage coil 32 are each formed separately. Each of these coils may be formed using a layer winding technique, wherein a conductor is wound in one or more concentric conductor layers connected in series. The conductor may be foil strip(s), sheet(s), or wire with a rectangular or circular cross-section. The conductor may be composed of copper or aluminum. A layer of insulation material is disposed between each pair of conductor layers.

Instead of being formed by a layer winding technique, each of the first and second high voltage coils 30, 32 may be formed using a disc winding technique, such as is shown in FIG. 3. In this technique, conductor(s) is/are wound in a plurality of discs 56 serially disposed along the axial length of the coil. In each disc 56, the turns are wound in a radial direction, one on top of the other, i.e., one turn per layer. The discs 56 are connected in a series circuit relation and are typically wound alternately from inside to outside and from outside to inside. The discs 56 can be continuously wound or may be provided with drop-downs. An insulating layer may be disposed between each layer or turn of the conductor. The insulating layers may be comprised of a polyimide film.

As shown in FIG. 3, the winding of the first and second high voltage coils 30, 32 can begin at the top of the first high voltage coil 30, at the main tap 46, and continue down to the bottom of the first high voltage coil 30. A jumper 58 connected between the taps 44, 48 connects a bottom-most one of the discs 56 in the first high voltage coil 30 to a bottom-most one of the discs 56 of the second high voltage coil 32. The winding continues up to the top of the second high voltage coil 32, with a gap between a pair of adjacent discs 56, and terminates at the main tap 42. The taps 40 are nominal taps for selecting the turns ratio of the transformer 10 depending on the incoming (nominal) power (if the transformer 10 is a step-down transformer). A pair of the nominal taps 40 are connected together by a jumper (not shown) to close the gap and complete the high voltage winding circuit. The main taps 42, 46 are for connection to a voltage source and, if the transformer 10 is a three-phase transformer to one or more main taps 42, 46 of the other high voltage coil assemblies 28. If the transformer 10 is a three-phase transformer, the high voltage coil assemblies 28 may be connected together in a delta configuration or a wye (or star) configuration.

Figure 4:
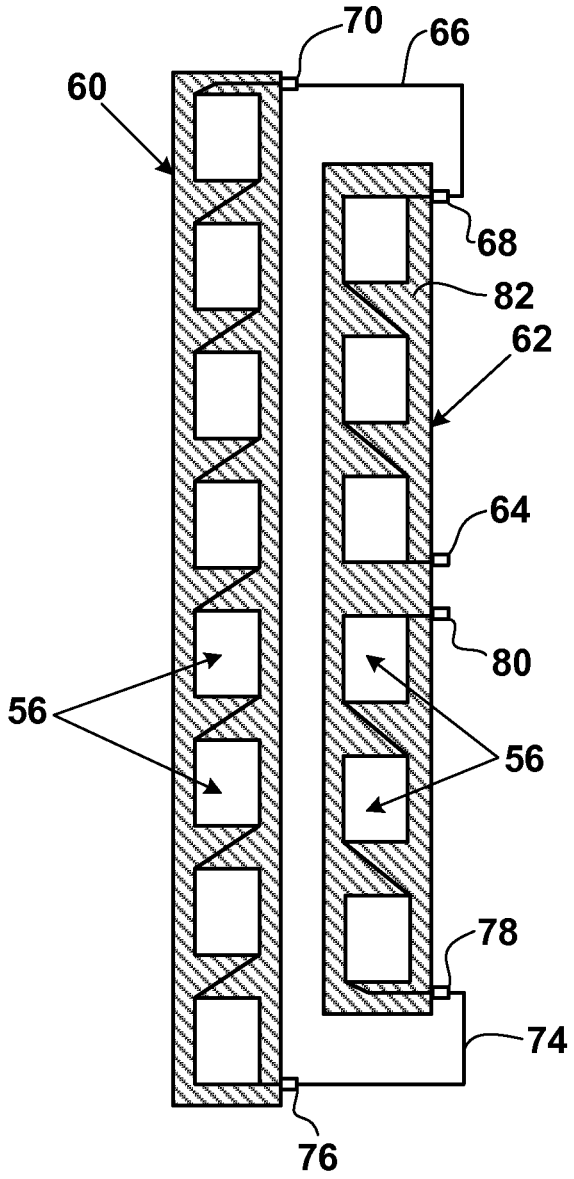
FIG. 4 is a cross-sectional view of a portion of first and second high voltage coils constructed in accordance with a second embodiment of the present invention.

It should be appreciated that other high voltage coils may be provided having a winding structure different from that shown in FIG. 3. For example, FIG. 4 shows a sectional view of a portion of a first voltage coil 60 and a second high voltage coil 62 that may be used in lieu of the first and second high voltage coils 30, 32. The winding of the first and second high voltage coils 60, 62 begins at the center of the second high voltage coil 62, at a main tap 64, and proceeds to the top of the second high voltage coil 62. A jumper 66 connected between nominal taps 68, 70 connects one of the discs 56 in a top portion of the second high voltage coil 62 to one of the discs 56 in a top portion of the first high voltage coil 60. The winding continues down the first high voltage coil 60 to a bottom-most one of the discs 56. A jumper 74 connected between nominal taps 76, 78 connects one of the discs 56 in a bottom portion of the first high voltage coil 60 to one of the discs 56 in a bottom portion of the second high voltage coil 62. The winding continues up to the center of the second high voltage coil 62 and terminates at the main tap 80. Although not shown, other nominal taps are provided at the top of each of the first and second high voltage coils 60, 62 and other nominal taps are provided at the bottom of each of the first and second high voltage coils 60, 62. Connecting together different pairs of nominal taps at the top and bottom of the first and second high voltage coils 60, 62 changes the turns ratio of the transformer 10.

In the embodiment shown in FIG. 3, the low voltage coil 26 is formed from alternating sheet conductor layers and sheet insulating layers that are continuously wound around an inner metal mold wrapped in an insulation layer comprised of woven glass. The sheet conductor layers may be formed from a continuous conductive sheet having a width that is substantially the same as the axial length of the low voltage coil 26.

In the embodiment of the present invention shown in FIG. 3, none of the coils 26, 30, 32 have cooling ducts formed therein. Thus, each of the coils 26, 30, 32 is substantially solid and has no cooling passages extending therethrough. In other embodiments, however, a limited number of cooling ducts may be formed between conductor layers in all or some of the coils 26, 30, 32. The cooling ducts may be pre-formed as shown in U.S. Pat. No. 7,023,312 to Lanoue et al., which is hereby incorporated by reference.

For each of the coil members 26, 30, 32, once the conductor has been wound, the wound conductor is encapsulated in an insulating resin 82 using a casting process. The wound conductor is placed in a metal mold and pre-heated in an oven to remove moisture from the insulation and the windings. This pre-heating step can also serve to cure any adhesive/resin impregnated in the insulating layers interposed between the turns of the conductor. The wound conductor/mold assembly is then placed in a vacuum casting chamber, which is then evacuated to remove any remaining moisture and gases. The resin 82 (in liquid state) is then introduced into the mold, which is still maintained under a vacuum, until the wound conductor is completely submerged. The conductor is held submerged in the resin 82 for a period of time sufficient to permit the resin 82 to impregnate the insulation layers and fill all spaces between adjacent conductor windings. The vacuum is then released and the wound conductor/mold assembly is removed from the chamber. The wound conductor/mold assembly is subsequently placed in an oven to cure the resin 82 to a solid state. After the resin 82 is fully cured, the wound conductor/mold assembly is removed from the oven and the mold is removed from the coil member.

The insulating resin 82 may be an epoxy resin or a polyester resin. An epoxy resin has been found particularly suitable for use as the insulating resin 82. The epoxy resin may be filled or unfilled. An example of an epoxy resin that may be used for the insulating resin 82 is disclosed in U.S. Pat. No. 6,852,415, which is assigned to ABB Research Ltd. and is hereby incorporated by reference. Another example of an epoxy resin that may be used for the insulating resin 82 is Rutapox VE-4883, which is commercially available from Bakelite AG of Iserlohn of Germany.

After the coils 26, 30, 32 have been individually formed, the coils 26, 30, 32 are mounted to a leg 22 of the core 18. The support blocks 50 are placed in their desired positions on top of the lower yoke 24 around the leg 22. The support blocks 50 may be secured to the yoke 24 by adhesive or physical fasteners. The low voltage coil 26 is first disposed over the leg 22 and positioned to rest on the support surfaces 52*a* of the support blocks 50, with the spacer 54*a* disposed radially outward from an outer surface of the low voltage coil 26. The first high voltage coil 30 is then disposed over the low voltage coil 26 and positioned to rest on the support surfaces 52*b* of the support blocks, with the spacer 54*a* disposed radially inward from an inner surface of the first high voltage coil 30 and the spacer 54*b* disposed radially outward from an outer surface of the first high voltage coil 30. The second high voltage coil 32 is then disposed over the first high voltage coil 30 and positioned to rest on the support surfaces 52*c* of the support blocks 50, with the spacer 54*b* disposed radially inward from an inner surface of the second high voltage coil 32. The first and second high voltage coils 30, 32 may be electrically connected together before or after the first and second high voltage coils 30, 32 are mounted to the leg 22.

Although only two high voltage coils 30, 32 have been shown and described, it should be appreciated that additional high voltage coils may be utilized. For example, a transformer may be provided having three or four concentrically arranged high voltage coils that are separated by annular cooling spaces. In addition, instead of providing a singular low voltage coil 26, a plurality of concentrically arranged low voltage coils separated by annular cooling spaces may be provided.

It is to be understood that the description of the foregoing exemplary embodiment(s) is (are) intended to be only illustrative, rather than exhaustive, of the present invention. Those of ordinary skill will be able to make certain additions, deletions, and/or modifications to the embodiment(s) of the disclosed subject matter without departing from the spirit of the invention or its scope, as defined by the appended claims.

What is claimed is:

1. A distribution transformer comprising:

a ferromagnetic core;

a coil assembly mounted to the core, the coil assembly comprising:

a resin-encapsulated low voltage coil;

a resin-encapsulated first high voltage coil disposed around the resin-encapsulated low voltage coil, said resin-encapsulated first high voltage coil having a total axial length that includes said resin; and a resin-encapsulated second high voltage coil disposed around the resin-encapsulated first high voltage coil, said resin-encapsulated second high voltage coil having a total axial length that includes said resin; and wherein the resin-encapsulated first high voltage coil is separated from the resin-encapsulated low voltage coil by an annular first space, and the resin encapsulated second high voltage coil is separated from the resin-encapsulated first high voltage coil by an annular second space, wherein the resin encapsulated low voltage coil and the resin-encapsulated first and second high voltage coils are arranged concentrically, and wherein the total axial length of the resin-encapsulated first high voltage coil is different than the total axial length of the resin-encapsulated second high voltage coil.

2. The distribution transformer of claim 1, wherein the resin-encapsulated low voltage coil has a different axial length than the resin encapsulated first high voltage coil.

3. The distribution transformer of claim 1, wherein the coil assembly is supported on a plurality of blocks, each block having first, second and third horizontal surfaces for supporting the resin-encapsulated low voltage coil, the resin encapsulated first high voltage coil and the resin-encapsulated second high voltage coil, respectively.

4. The distribution transformer of claim 3, wherein the first and second horizontal surfaces are separated by a vertically-extending first spacer and the second and third horizontal surfaces are separated by a vertically-extending second spacer.

5. The distribution transformer of claim 4, wherein the first spacer extends into the first space and the second spacer extends into the second space.

6. The distribution transformer of claim 3, wherein the first, second and third horizontal surfaces are disposed at different heights, respectively.

7. The distribution transformer of claim 1, wherein the low voltage coil is a secondary coil and the first and second high voltage coils are primary coils.

8. The distribution transformer of claim 1, wherein the low voltage coil, the first high voltage coil and the second high voltage coil are each encapsulated in an epoxy resin.

9. The distribution transformer of claim 1, wherein the distribution transformer is a three-phase transformer, the coil assembly is a first coil assembly, and the distribution transformer further comprises second and third coil assemblies, each of which has a construction substantially the same as the first coil assembly.

10. The distribution transformer of claim 1, further comprising a plurality of first taps extending laterally outward from an outer surface of the first high voltage coil.

11. The distribution transformer of claim 10, further comprising a plurality of second taps extending laterally outward from an outer surface of the second high voltage coil.

12. The distribution transformer of claim 10, wherein at least one of the first taps is disposed above a top end of the second high voltage coil.

13. The distribution transformer of claim 10, wherein at least one of the taps is disposed below a bottom end of the second high voltage coil.

14. The distribution transformer of claim 1, wherein the first high voltage coil does not have any cooling passages extending between top and bottom ends of the first high voltage coil.

15. The distribution transformer of claim 1, wherein the first high voltage coil is electrically connected to the second high voltage coil.

16. A distribution transformer comprising:

a ferromagnetic core;

a coil assembly mounted to the core, the coil assembly comprising:

a low voltage coil member including resin insulation;

a first high voltage coil member having a total axial length that includes resin insulation, the first high voltage coil member disposed around the low voltage coil member; and a second high voltage coil member having a total axial length that includes resin insulation, the second high voltage coil member disposed around the first high voltage coil member; and wherein the first high voltage coil member is separated from the low voltage coil member by an annular first space, and the second high voltage coil member is separated from the first high voltage coil member by an annular second space, wherein the low voltage coil member and the first and second high voltage coil members are arranged concentrically, and wherein the first high voltage coil member axial length from one axial end of the resin insulation to an opposite axial end of the resin insulation is different than the axial length of the second high voltage coil member.

* * * * *